US006385890B1

(12) United States Patent
Amadini

(10) Patent No.: US 6,385,890 B1
(45) Date of Patent: May 14, 2002

(54) FIREARM LOCKING MECHANISM

(76) Inventor: Sandro Amadini, Via X Giornate 821 B, 25063 Gardone VT (BS) (IT)

( * ) Notice: Subject to any disclaimer, the term of this patent is extended or adjusted under 35 U.S.C. 154(b) by 0 days.

(21) Appl. No.: 09/885,606

(22) Filed: Jun. 20, 2001

(51) Int. Cl.[7] ..... F41A 17/00
(52) U.S. Cl. ..... 42/70.11; 42/70.07; 224/243
(58) Field of Search ..... 42/70.11, 70.06, 42/70.01, 70.07; 224/243, 193, 198

(56) References Cited

U.S. PATENT DOCUMENTS 5,621,996 A * 4/1997 Mowl, Jr. ..... 42/70.07
5,810,222 A * 9/1998 Shoemaker ..... 224/244
6,085,951 A * 7/2000 Beletsky et al. ..... 224/243
6,267,279 B1 * 7/2001 Matthews ..... 224/243
6,272,784 B1 * 8/2001 Ringers ..... 42/70.07

* cited by examiner

*Primary Examiner*—J. Woodrow Eldred
(74) *Attorney, Agent, or Firm*—J. Sanchelima; A. Bordas

(57) ABSTRACT

A firearm locking mechanism for handguns primarily comprising a locking assembly with first and second ends, said first end having first and second arms bifurcated parallel and spaced apart to receive a handgun. The locking assembly further has an elongated member, which serves as latching means to remove the firearm from the locking assembly. Interacting with the elongated member is a locking system controlled by a key, giving the authorized user the ability to set the firearm locking assembly in a "locked" or "unlocked" mode. The firearm locking assembly prevents the removal of the handgun when the trigger guard is obstructed within the first and second arms. The present invention is primarily utilized with firearms such as pistols and revolvers.

15 Claims, 5 Drawing Sheets

FIREARM LOCKING MECHANISM

BACKGROUND OF THE INVENTION

1. Field of the Invention.

The present invention relates to a locking mechanism for weapons, and more particularly, to a firearm locking mechanism for handguns.

2. Description of the Related Art.

Firearms, pistols, and revolvers are very dangerous. Every year many people are accidentally injured and killed when unauthorized users fire them, especially minors. Presently, holsters are manufactured without a built-in ability to place them in a "locked" or "unlocked" mode. There is a need for a practical and inexpensive locking mechanism that can house handguns to reduce the possibilities of unauthorized users from utilizing them.

There are no similar firearm locking mechanisms to the best of applicant's knowledge, that may be utilized to secure a handgun in a holster and placed in a "locked" or "unlocked" mode, that utilize a key.

SUMMARY OF THE INVENTION

The instant invention is a firearm locking mechanism, which is housed in a holster. It comprises a locking assembly with first and second ends, said first end having first and second arms bifurcated parallel and spaced apart a first predetermined distance from each other, each with interior and exterior walls. Said exterior wall of said first arm having a locking-pin spring receiving a locking-pin therethrough. The locking assembly further having latching means to secure a firearm including a trigger guard within said arms. The latching means includes a ball protruding from said interior wall of said second arm.

The locking assembly also has an elongated lever with third and fourth ends axially slidable along said exterior wall of said second arm. The elongated lever cammingly forcing the ball to protrude from said interior wall of said second arm a second predetermined distance to block the trigger guard of the firearm.

The locking assembly further comprising locking means to lock said firearm within said locking assembly wherein said locking means includes a key. The key is insertable through an aperture of said exterior wall of said first arm so that a user exerting an inwardly and rotational force to overcome the force of said locking-pin spring, and rotating said locking-pin selectively from a locked mode position to an unlocked mode position and vice-a-versa, whereas said lockingpin is shifted thereby restricting the travel of said elongated lever that permits the locking of said firearm in said locking assembly.

The firearm locking mechanism may also comprise a belt shank having a swivel head with a dovetail to receive said second arm of said locking assembly and mounted onto a swivel base. The swivel base has position means to angularly vary said firearm position while in the firearm holster. The position means includes a handle affixed to a bolt and bolt spring assembly, so that a user exerting an outwardly force to overcome the force of said bolt spring, and rotating said swivel head to an angular position. Alternatively, to secure a firearm to a desk or wall for example, a shank having a dovetail to receive said second arm of said locking assembly may be utilized.

As mentioned above, the instant invention has latching means to secure a firearm including a trigger guard. These means include a ball protruding from said interior wall of said second arm. The instant invention further has unlatching means for removing the firearm from said locking assembly.

In greater detail, the elongated lever has a first through-hole a third predetermined distance from said third end towards said fourth end, without reaching said fourth end. A first recess a fourth predetermined distance from said first through-hole towards said fourth end, without reaching said fourth end. A first longitudinal channel extending a fifth predetermined distance from said first recess towards said fourth end without reaching said fourth end. A second recess a sixth predetermined distance from said first recess towards said fourth end without reaching said fourth end. A second longitudinal channel within said first longitudinal channel a seventh predetermined distance from said second recess extending an eighth predetermined distance towards said fourth end without reaching said fourth end, and a second through-hole within said second longitudinal channel a ninth predetermined distance from said fourth end.

The latching means includes a through-pin with fifth and sixth ends, said fifth end having a leg extending radially outwardly a tenth predetermined distance. The leg having cooperative dimensions to fit within said first and second arms for securing said firearm within said locking assembly whereas said through-pin shifts so that said sixth end is selectively removed from said second recess thereby permitting travel of said elongated member and said ball riding on said second longitudinal channel blocking said trigger guard.

The unlatching means includes an operating spring, biased against said fourth end so that a user may remove said firearm from said firearm locking assembly by exerting a force on said third end to overcome the force of said operating spring. This action shifts said through-pin and said ball selectively from a latched mode position to an unlatched mode position, whereas said through-pin shifts so that said sixth end is selectively brought in alignment and enters said second recess and said ball resting on said first recess that permits the removal of said firearm from said locking assembly.

It is therefore one of the main objects of the present invention to provide a firearm locking mechanism for handguns that is utilized to secure a handgun within a holster, reducing the possibilities of injury by unauthorized users.

It is another object of this invention to provide a firearm locking mechanism in which the locking mechanism is utilized as a means to prevent the removal of a handgun from a holster assembly.

It is another object of the present invention to secure a firearm within a holster.

It is still another object of this invention to provide a firearm locking mechanism for handguns that includes a manual release elongated lever.

It is another object of this invention to provide a firearm locking mechanism for handguns that may include a key to set the instant invention in a "locked" or "unlocked" mode.

It is still another object of the present invention to provide a locking mechanism for firearms and handguns in particular.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
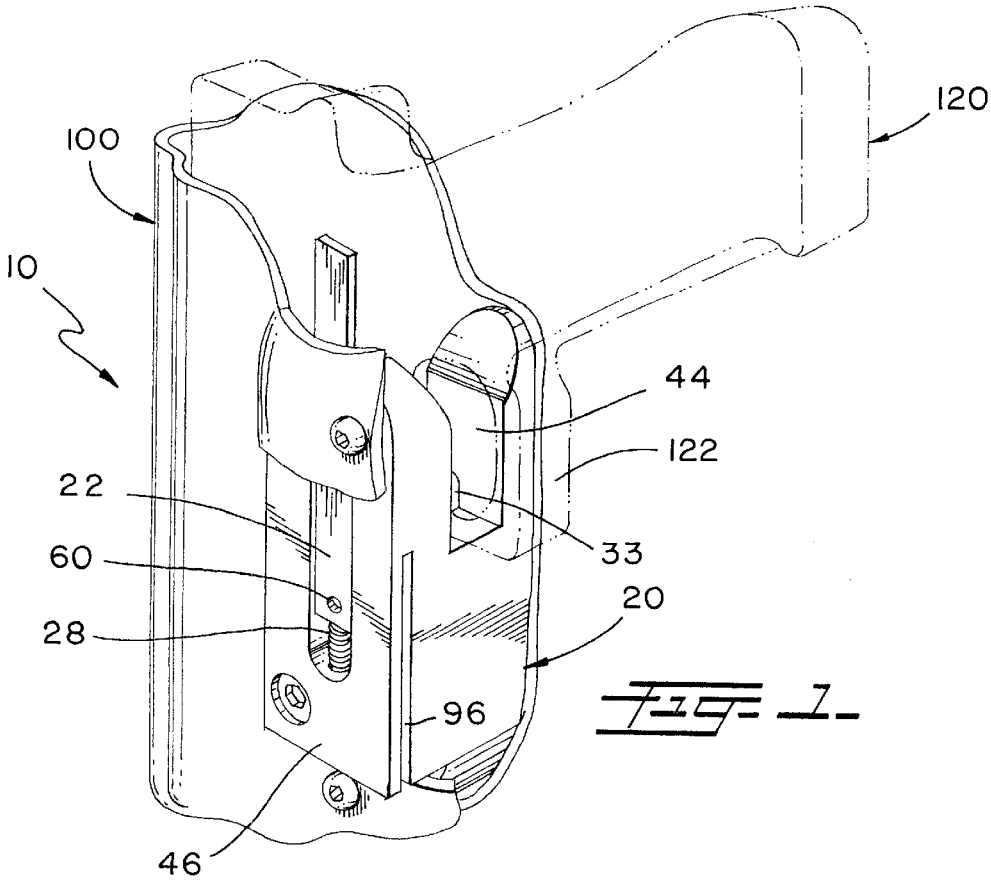
FIG. 1 shows a perspective view of the instant invention with a firearm shown in phantom.

Referring now to the drawings, where the present invention is generally referred to with numeral 10, it can be observed that it basically includes locking assembly 20 and elongated lever 22.

As seen in FIG. 1, instant invention 10 comprises locking assembly 20, which is housed in holster 100. A firearm, such as firearm 120 having trigger guard 122 may be secured in instant invention 10.

Locking assembly 20 has elongated lever 22, which acts as a means for latching trigger guard 122 of firearm 120. When latched, trigger guard 122 is obstructed, preventing the removal of firearm 120 until elongated lever 22 in pressed in a downward direction in this configuration towards and compressing operating spring 28. While latched, firearm 120 fits between interior walls 44 and 42, seen in FIG. 4. Locking assembly 20 also has exterior walls 46 and 48, seen in FIG. 4. Channel 96 is of cooperative dimensions to slidably fill dovetail 84, seen in FIG. 6.

Figure 2:
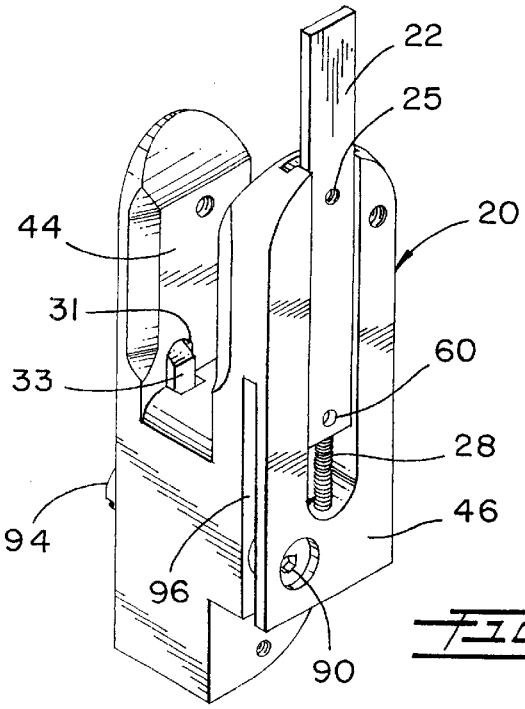
FIG. 2 shows a perspective view of the locking assembly.

Seen in FIG. 2 is locking assembly 20 without holster 100. Elongated lever 22 longitudinally slides within a dovetail of exterior wall 46. Operating spring 28 is biased against elongated lever 22. Screw 25 trespasses elongated lever 22 and travels within channel 27, seen in FIG. 3, to keep elongated lever 22 secure within the dovetail of exterior wall 46. Leg 33 protrudes through hole 31 of interior wall 44. To place in a latched mode position, firearm 120 and specifically trigger guard 122, seen in FIG. 1, are introduced to locking assembly 20. Trigger guard 122 makes contact with leg 33 and causes it to shift inward towards interior wall 44. Once leg 33 shifts inward, it cooperates with elongated lever 22, causing it to shift and expand operating spring 28 until screw 25 reaches the top portion of channel 27, seen in FIG. 3.

Figure 3:
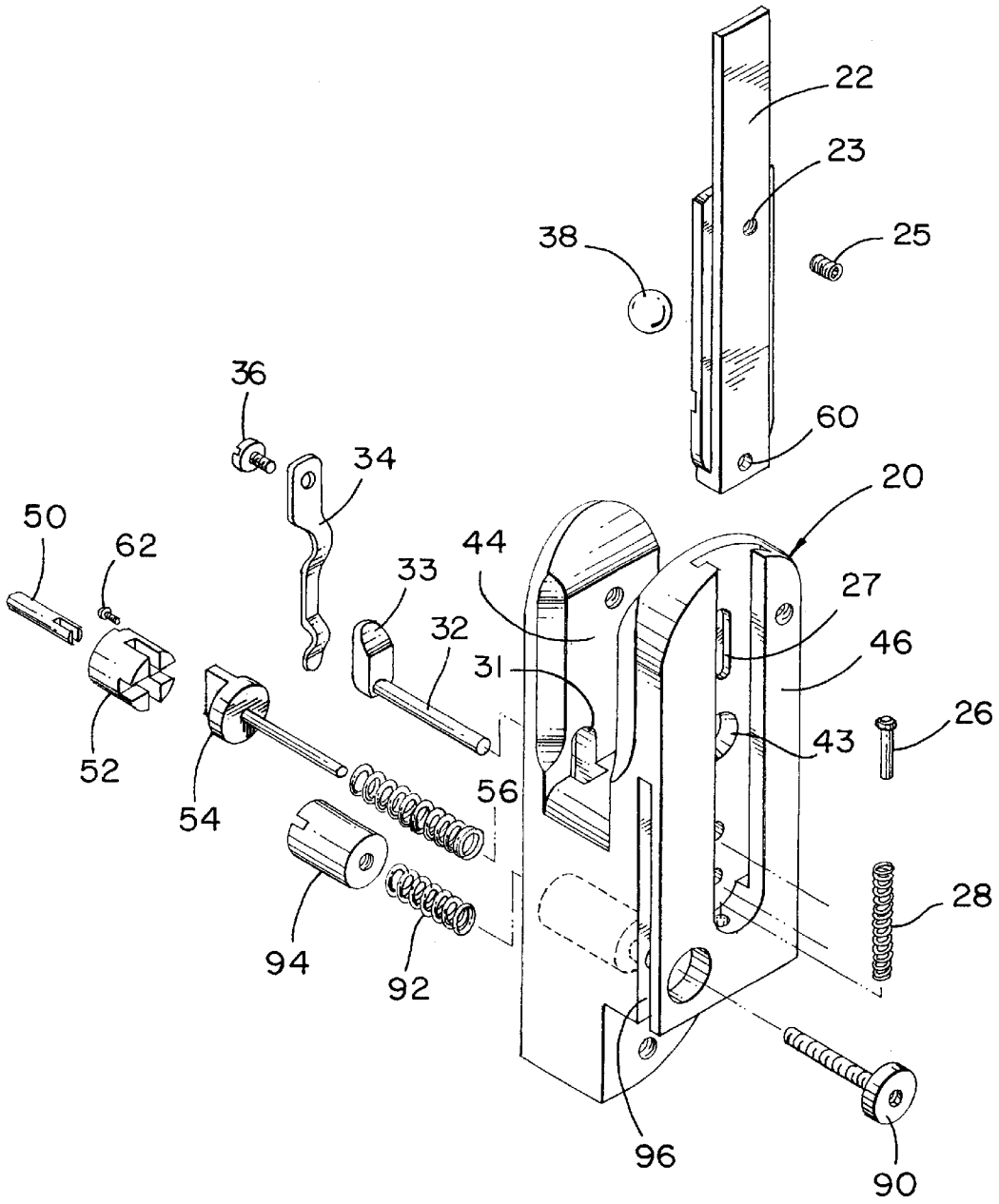
FIG. 3 represents an angled exploded view of the locking assembly.

As seen in FIG. 3, elongated lever 22 has through hole 23 to receive screw 25. Screw 25 travels longitudinally within channel 27 to maintain elongated lever 22 within the dovetail of exterior wall 46. While within the dovetail of exterior wall 46, elongated lever 22 sits upon pin 26, which fits within operating spring 28.

Figure 4:
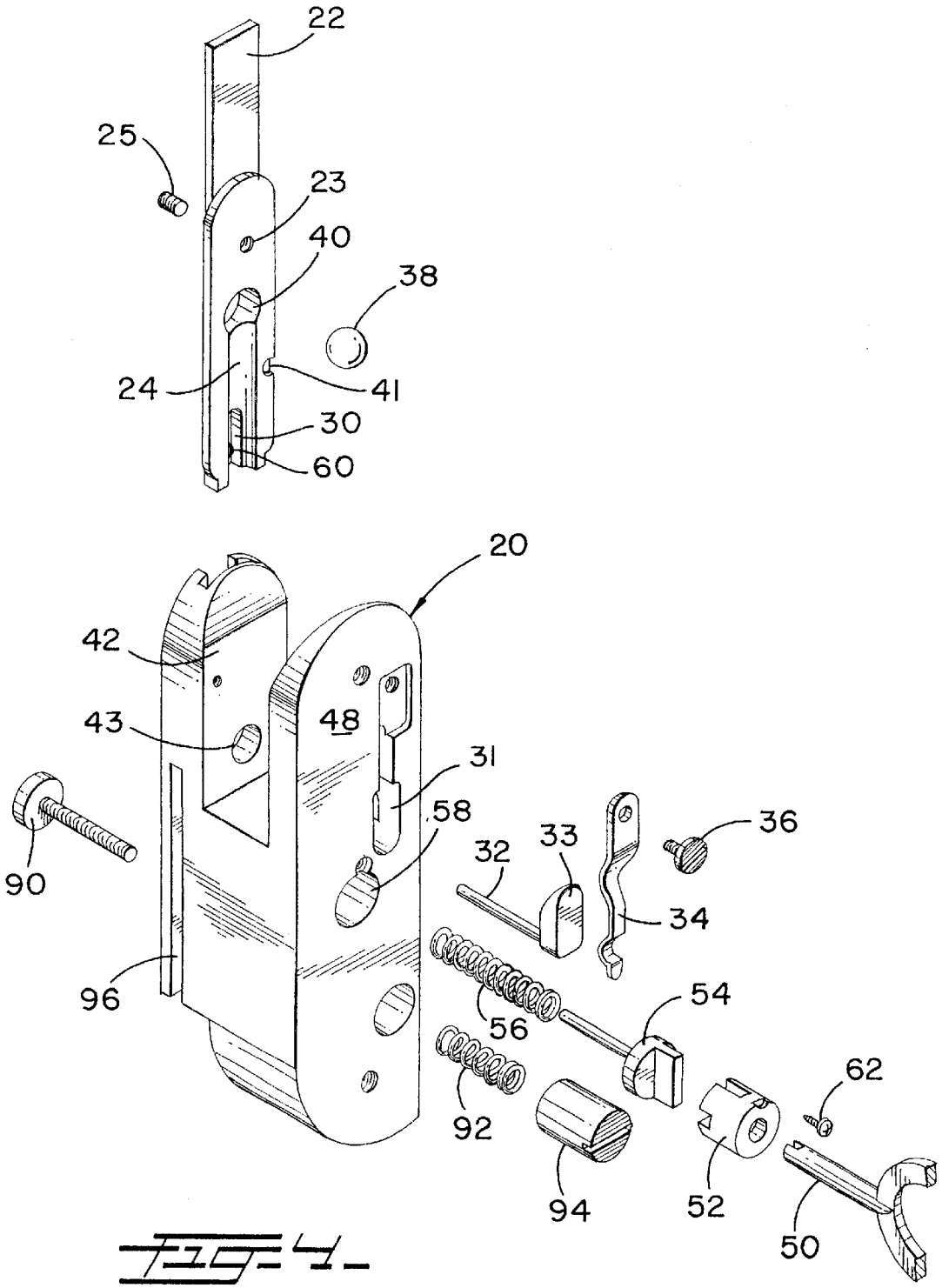
FIG. 4 represents another angled exploded view of the locking assembly.

As best seen in FIG. 4, elongated lever 22 has recess 40 to receive ball 38. Locking assembly 20 is in the unlatched mode position when ball 38 is within recess 40. Extending from recess 40 is ball channel 24. When ball 38 rides on ball channel 24 it partially protrudes from hole 43. In this position, locking assembly 20 is in the latched mode position. The latched mode position describes when ball 38 obstructs trigger guard 122, seen in FIG. 1, through hole 43. Alongside ball channel 24 is recess 41. Recess 41 receives an end of through pin 32 to place locking assembly 20 in the unlatched mode position. Screw 36 secures return spring 34 onto exterior wall 48. The force of return spring 34 keeps leg 33 biased against the slot within exterior wall 48.

Within ball channel 24 is pin channel 30. One end of locking pin 54 rides within pin channel 30 while in the unlocked mode position. To place instant invention 10 in the locked mode position, key 50 is placed through head 52 and onto locking pin 54, which trespasses exterior walls 46 and 48. Overcoming the force of locking pin spring 56, key 50 is forced inwardly while rotating until an end of locking pin 54 trespasses locking pin hole 60. In this position, elongated lever 22 remains stationary, keeping ball 38 on ball channel 24. To refrain the force of locking pin spring 56, retain screw 62 keeps head 52 within aperture 58.

Figure 6:
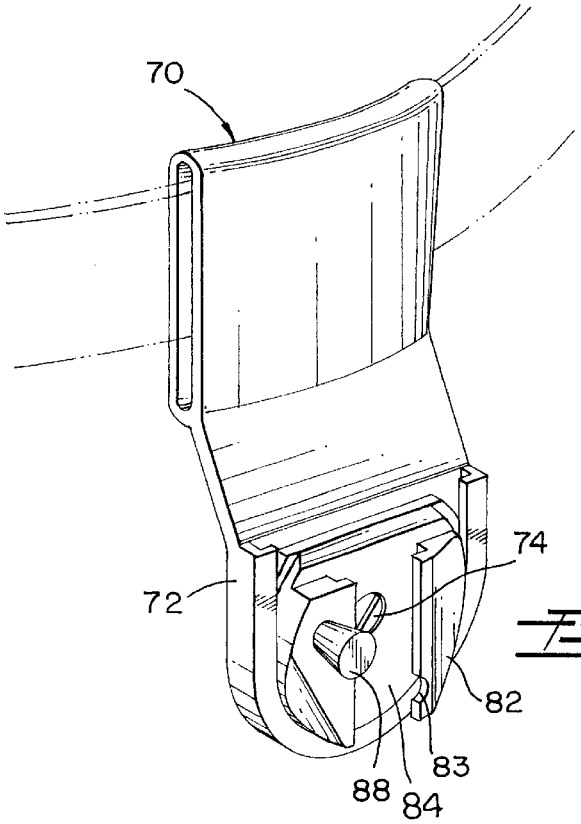
FIG. 6 represents a perspective view of the belt shank assembly.

Channel 96 within exterior wall 46 slides into dovetail 84, seen in FIG. 6. In a relaxed state, bolt 90 blocks the clearance of channel 96. To clear the path of channel 96, bushing 94, which connects to bolt 90, is pressed from the side of exterior wall 48 to overcome the force of bolt spring 92.

Figure 5C:
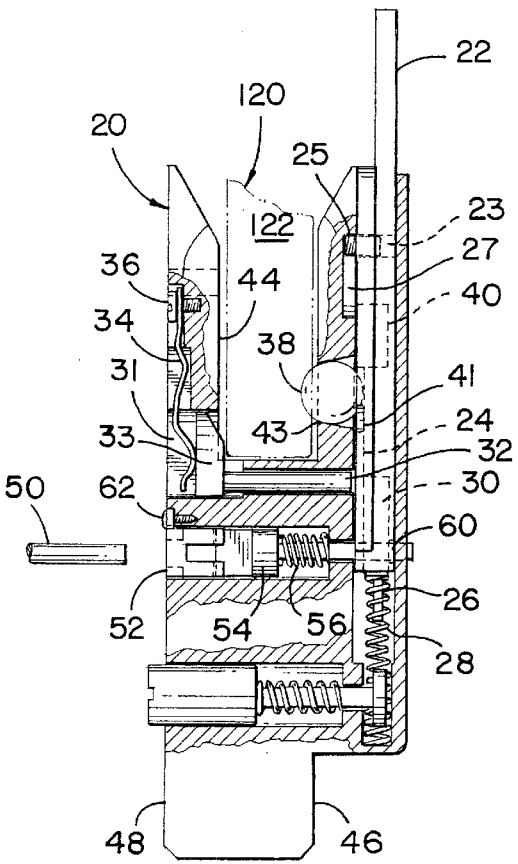
FIG. 5*c* shows an isometric view of the locking assembly in a latched and locked mode position.
Figure 5B:
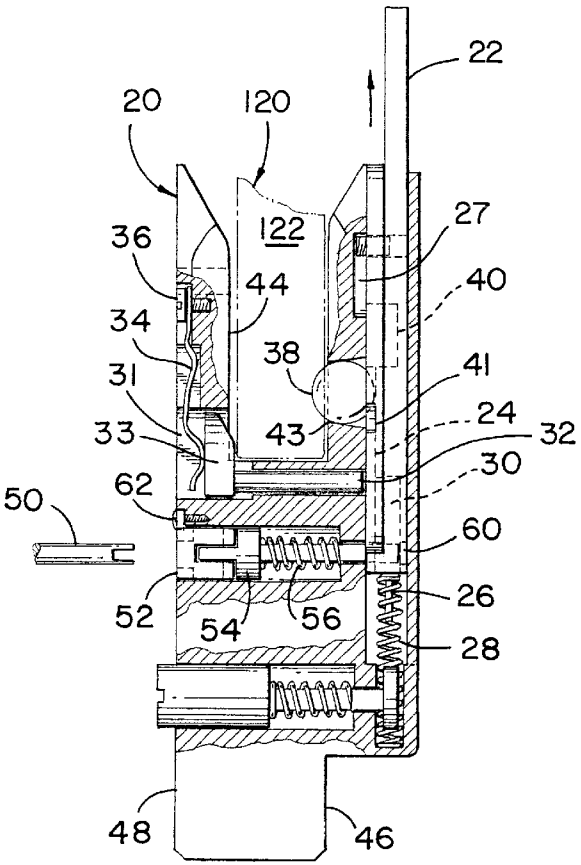
FIG. 5*b* shows an isometric view of the locking assembly in a latched and unlocked mode position.
Figure 5A:
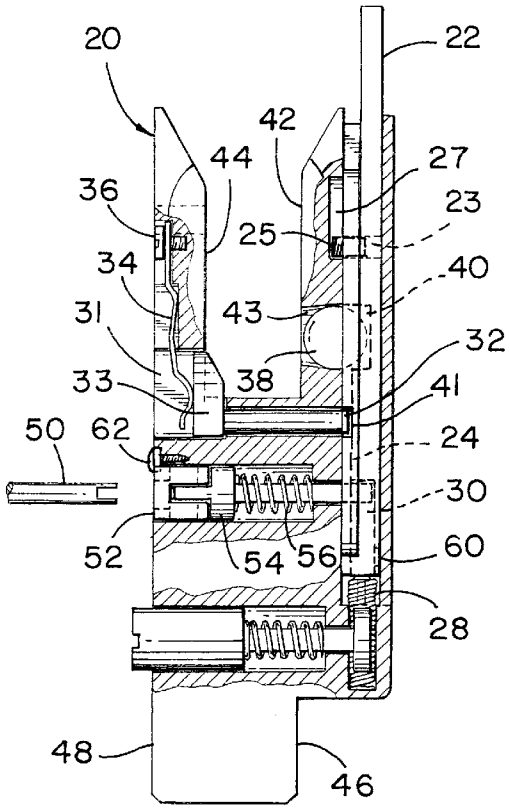
FIG. 5*a* shows an isometric view of the locking assembly in an unlatched and unlocked mode position.

As best seen in FIG. 5*a*, locking assembly 20 is in the unlatched and unlocked mode position. In this position, trigger guard 122 has not been introduced. In the unlatched mode position, ball 38 is within recess 40; leg 33 protrudes from interior wall 44; and the end of through pin 32 is in recess 41. In the unlocked mode position, the end of locking pin 54 is not within locking pinhole 60.

As best seen in FIG. 5*b*, locking assembly 20 is in the latched and unlocked mode position. In this position, trigger guard 122 has been introduced. In the latched mode position, ball 38 is on ball channel 24; protruding from hole 43; leg 33 does not protrude from interior wall 44; and the end of through pin 32 is not in recess 41. In the unlocked mode position, the end of locking pin 54 is not within locking pinhole 60.

As best seen in FIG. 5*c*, locking assembly 20 is in a latched and locked mode position. In this position, trigger guard 122 has been introduced. In the latched mode position, ball 38; is on ball channel 24; protruding from hole 43; leg 33 does not protrude from interior wall 44; and the end of through pin 32 is not in recess 41. In the unlocked mode position, the end of locking pin 54 is within locking pinhole 60.

Figure 6A:
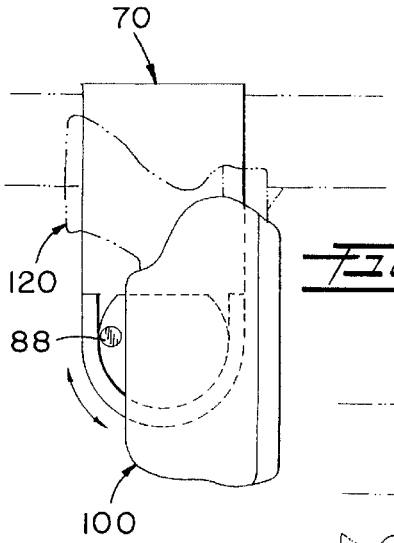
FIG. 6*a* shows an elevational view of the instant invention with the holster in a vertical position.
Figure 6B:
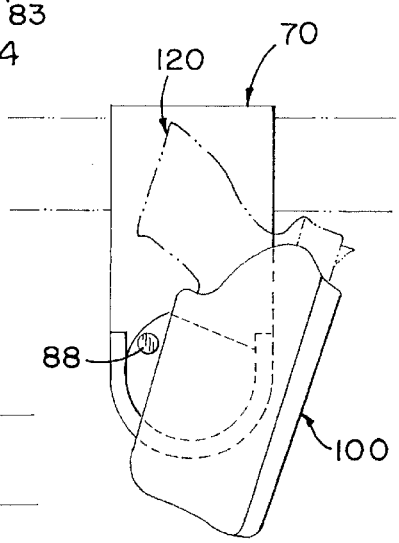
FIG. 6*b* shows an elevational view of the instant invention with the holster in a horizontal position.
Figure 6C:
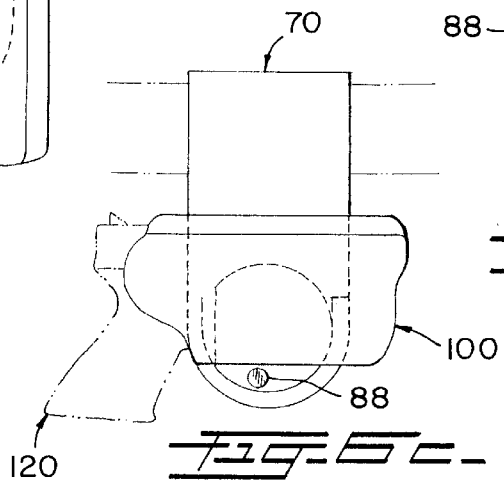
FIG. 6*c* shows an elevational view of the instant invention with the holster in a tilted position.

As seen in FIG. 6, belt shank assembly 70 may fit onto a belt. Belt shank assembly 70 comprises swivel head 82, which is mounted on swivel base 72. Screw 74 secures swivel head 82 thereon and is screwed into a nut plate or the equivalent. Swivel head 82 has dovetail 84 to receive channel 96, seen in FIG. 2. To secure locking assembly 20 onto belt shank assembly 70, bushing 94 is pressed to clear the path of channel 96, seen in FIG. 4. Once clear, locking assembly 20 is slid onto dovetail 84 until the head of bolt 90 fills cutout 83. Once secure, firearm 120 will be in the position as shown in FIG. 6*a*. The user may pull on handle 88 and rotate swivel head 82 into various predetermined positions as shown in FIGS. 6*b* and 6*c*. Swivel base 72 has holes in predetermined areas to receive a pin trespassing through a spring, not shown, which is removably secured to handle 88. Pulling on handle 88 compresses the spring and brings the end of the pin out of the hole, to enable the user to rotate swivel head 82 to the preferred position.

Instant invention 10 may secure any variety of firearms that have a trigger guard. Such a handgun may be a "GLOCK", "FNM-49", "SIGMA", "KAHR "or "SMITH & WESSON", without limitation to these specific brands. Additionally, revolvers such as "COLT", "RUGER", and "SMITH & WESSON" may also be secured within instant invention 10, without limitation to these specific brands.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm locking mechanism, comprising:

A) a locking assembly with first and second ends, said first end having first and second arms bifurcated parallel and spaced apart a first predetermined distance from each other, each with interior and exterior walls, said exterior wall of said first arm having a locking-pin spring receiving a locking-pin therethrough, said locking assembly further having latching means to secure a firearm including a trigger guard within said arms, said latching means includes a ball protruding from said interior wall of said second arm; and B) an elongated lever with third and fourth ends axially slidable along said exterior wall of said second arm, said elongated lever cammingly forcing said ball to protrude from said interior wall of said second arm a second predetermined distance to block the trigger guard of said firearm.

2. The firearm locking mechanism set forth in claim 1, said firearm locking assembly further comprising locking means to lock said firearm within said locking assembly.

3. The firearm locking mechanism set forth in claim 2, wherein said locking means includes a key, insertable through an aperture of said exterior wall of said first arm so that a user exerting an inwardly and rotational force to overcome the force of said locking-pin spring, and rotating said locking-pin selectively from a locked mode position to an unlocked mode position and vice-a-versa.

4. The firearm locking mechanism set forth in claim 3, wherein said locking assembly is housed within a firearm holster.

5. The firearm locking mechanism set forth in claim 4, further comprising a belt shank having a swivel head with a dovetail to receive said second arm of said locking assembly and mounted onto a swivel base, with position means to angularly vary said firearm position while in said firearm holster.

6. The firearm locking mechanism set forth in claim 5, wherein said position means includes a handle affixed to a bolt and bolt spring assembly, so that a user exerting an outwardly force to overcome the force of said bolt spring, and rotating said swivel head to an angular position.

7. A firearm locking mechanism, comprising:

A) a locking assembly with first and second ends, said first end having first and second arms bifurcated parallel and spaced apart a first predetermined distance from each other, each with interior and exterior walls, said exterior wall of said first arm having a locking-pin spring receiving a locking-pin therethrough, said locking assembly further having latching means to secure a firearm including a trigger guard within said arms, said latching means includes a ball protruding from said interior wall of said second arm, and unlatching means for removing said firearm from said locking assembly; and B) an elongated lever with third and fourth ends axially slidable along said exterior wall of said second arm, having a first through-hole a third predetermined distance from said third end towards said fourth end, without reaching said fourth end, a first recess a fourth predetermined distance from said first through-hole towards said fourth end, without reaching said fourth end, a first longitudinal channel extending a fifth predetermined distance from said first recess towards said fourth end without reaching said fourth end, a second recess a sixth predetermined distance from said first recess towards said fourth end without reaching said fourth end, a second longitudinal channel within said first longitudinal channel a seventh predetermined distance from said second recess extending an eighth predetermined distance towards said fourth end without reaching said fourth end, and a second through-hole within said second longitudinal channel a ninth predetermined distance from said fourth end, said elongated lever cammingly forcing said ball to protrude from said interior wall of said second arm a second predetermined distance to block the trigger guard of said firearm.

8. The firearm locking mechanism set forth in claim 7, wherein said latching means includes a through-pin with fifth and sixth ends, said fifth end having a leg extending radially outwardly a tenth predetermined distance, said leg having cooperative dimensions to fit within said first and second arms for securing said firearm within said locking assembly whereas said through-pin shifts so that said sixth end is selectively removed from said second recess thereby permitting travel of said elongated member and said ball riding on said second longitudinal channel blocking said trigger guard.

9. The firearm locking mechanism set forth in claim 8, wherein said unlatching means includes an operating spring, biased against said fourth end so that a user may remove said firearm from said firearm locking assembly exerting a force on said third end to overcome the force of said operating spring, and shifting said through-pin and said ball selectively from a latched mode position to an unlatched mode position, whereas said through-pin shifts so that said sixth end is selectively brought in alignment and enters said second recess and said ball resting on said first recess that permits the removal of said firearm from said locking assembly.

10. The firearm locking mechanism set forth in claim 9, said firearm locking assembly further comprising locking means to lock said firearm within said locking assembly.

11. The firearm locking mechanism set forth in claim 10, wherein said locking means includes a key, insertable through an aperture of said exterior wall of said first arm so that a user exerting an inwardly and rotational force to overcome the force of said locking-pin spring, and rotating said locking-pin selectively from a locked mode position to an unlocked mode position and vice-a-versa, whereas said locking-pin is shifted into said second through-hole thereby restricting the travel of said elongated lever that permits the locking of said firearm in said locking assembly.

12. The firearm locking mechanism set forth in claim 11, wherein said locking assembly is housed within a firearm holster.

13. The firearm locking mechanism set forth in claim 12, further comprising a belt shank having a swivel head with a dovetail to receive said second arm of said locking assembly and mounted onto a swivel base, with position means to angularly vary said firearm position while in said firearm holster.

14. The firearm locking mechanism set forth in claim 13, wherein said position means includes a handle affixed to a bolt and bolt spring assembly, so that a user exerting an outwardly force to overcome the force of said bolt spring, and rotating said swivel head to an angular position.

15. The firearm locking mechanism set forth in claim 12, further comprising a shank having a dovetail to receive said second arm of said locking assembly.

* * * * *